United States Patent [19]

Gegan

[11] Patent Number: 4,766,440

[45] Date of Patent: Aug. 23, 1988

[54] TRIPLE FREQUENCY U-SLOT MICROSTRIP ANTENNA

[75] Inventor: Michael J. Gegan, Menlo Park, Calif.

[73] Assignee: The United States of America as represented by the Secretary of the Navy, Washington, D.C.

[21] Appl. No.: 909,363

[22] Filed: Dec. 11, 1986

[51] Int. Cl.[4] ..... H01Q 1/38; H01Q 13/08

[52] U.S. Cl. ..... 343/700 MS; 343/767

[58] Field of Search ..... 343/700 MS, 725, 767, 343/769, 770, 771, 829, 830, 846

[56] References Cited

U.S. PATENT DOCUMENTS

| | | | |
|---|---|---|---|
| 4,074,270 | 2/1978 | Kaloi | 343/700 MS |
| 4,130,822 | 12/1978 | Conroy | 343/700 MS |
| 4,191,959 | 3/1980 | Kerr | 343/700 MS |
| 4,259,670 | 3/1981 | Schiavone | 343/700 MS |
| 4,356,492 | 10/1982 | Kaloi | 343/700 MS |
| 4,364,050 | 12/1982 | Lopez | 343/700 MS |
| 4,367,474 | 1/1983 | Schaubert et al. | 343/700 MS |
| 4,410,891 | 10/1983 | Schaubert et al. | 343/700 MS |

FOREIGN PATENT DOCUMENTS

| | | | |
|---|---|---|---|
| 61804 | 5/1981 | Japan | 343/700 MS |
| 215808 | 12/1983 | Japan | 343/700 MS |

*Primary Examiner*—William L. Sikes
*Assistant Examiner*—Michael C. Wimer
*Attorney, Agent, or Firm*—C. D. B. Curry; K. S. Moss; W. C. Daubenspeck

[57] ABSTRACT

A microstrip antenna employing a rectangular radiating element having a U-shaped slot oriented parallel to the length of the radiating element and employing a single feedline coplanar with the radiating element. The slotted radiating element has three resonances: a length resonance polarized parallel to the length of the element; a width resonance polarized parallel to the width of the element; and a slot resonance polarized parallel to the length of the element. By proper selection of the length and location of the slot, the frequency of the slot resonance can be placed such that a region of circular polarization occurs between the width resonance and the slot resonance. Alternatively, a region of circular polarization can be created between the length resonance and the width resonance since they are also polarized perpendicular to each other. Thus the U-slotted antenna provides either triple-frequency operation or dual-frequency operation in which one frequency is circularly polarized and the other frequency is elliptically polarized.

12 Claims, 6 Drawing Sheets

IMPEDANCE PLOT

TRIPLE FREQUENCY U-SLOT MICROSTRIP ANTENNA

BACKGROUND OF THE INVENTION

The present invention relates in general to low physical profile antennas and, in particular, to a coplanar microstrip antenna having three resonances. The invention relates especially to a microstrip antenna having three-frequency operation in which two frequencies can be spaced slightly apart to achieve a circularly polarized signal at the midfrequency point and an elliptically polarized signal at the third frequency.

One design of multiple-frequency antennas employs an antenna structure in which single-band microstrip radiating elements are stacked above a ground plane with the surface of each element dimensioned so as to resonate at a different frequency. Each of the radiating elements is fed with a separate feedline, either a coplanar feedline or a coaxial-to-microstrip adapter normal to the plane of the radiating element. The multiple layers and the multiple feedlines result in a less compact and more complex structure than is desirable for some aerospace applications.

Multiple band operation has been provided using microstrip antennas and feed networks etched on the same surface. U.S. Pat. No. 4,356,492 discloses a dual band antenna in which two single-band coplanar radiating elements are fed from a common coplanar input point.

Instantaneous dual band operation using single element microstrip antennas and feed networks etched on the same surface require either (1) microstrip antennas with a single feedline on the same surface as the antenna (coplanar antenna) or (2) diplexed output ports on the feed network. In general, dual band, coplanar, single feedline antenna designs are available only if the frequencies of interest are within 15 percent of each other or are harmonically related. Diplexers in the feed network result in a larger, less efficient, and more complex microstrip antenna array.

Copending U.S. patent application, Ser. No. 856,569, now U.S. Pat. No. 4,692,769, entitled Dual Band Slotted Microstrip Antenna, by the same inventor as in the present application, discloses instantaneous dual band operation in a slotted microstrip radiating element wherein the two resonances are perpendicularly polarized and may be separated by as much as a 2:1 ratio.

However, none of these foregoing designs provides instantaneous triple frequency operation of a microstrip antenna and an undiplexed feed network etched on the same surface. Nor do these designs provide instantaneous dual frequency operation of a microstrip antenna and undiplexed feed network in which one frequency is circularly polarized and the other frequency is linearly polarized. Instantaneous triple frequency operation or dual frequency operation in which one frequency is circularly polarized and the other elliptically polarized allows a smaller, more efficient and less complex microstrip array antenna.

SUMMARY OF THE INVENTION

It is therefore an object of the present invention to provide a smaller, more efficient, and less complex microstrip antenna.

Another object is to provide a triple frequency low profile antenna.

Another object is to provide a microstrip antenna capable of supporting instantaneous triple-frequency operation with an undiplexed coplanar feed network.

A further object is to provide a microstrip antenna capable of supporting dual-frequency operation in which one frequency is circularly polarized and the other frequency is elliptically polarized with an undiplexed coplanar feed network.

These objects are provided by a microstrip antenna employing a rectangular radiating element having a U-shaped slot oriented parallel to the length of the radiating element and employing a single feedline coplanar with the radiating element. The slotted radiating element has three resonances: a length resonance polarized parallel to the length of the element and having a frequency primarily determined by the length dimension of the element; a width resonance polarized parallel to the width of the element and having a frequency primarily determined by the width of the element; and a slot resonance polarized parallel to the length of the element and having a frequency primarily controlled by the length of the slot. Since the polarizations of the width resonance and the slot resonance are perpendicular to each other, by proper selection of the length and location of the slot, the frequency of the slot resonance can be placed such that a region of circular polarization occurs between the width resonance and the slot resonance. Alternatively, a region of circular polarization can be created between the length resonance and the width resonance since they are also polarized perpendicular to each other. Thus the U-slotted antenna provides either triple-frequency operation or dual-frequency operation in which one frequency is circularly polarized and the other frequency is elliptically polarized.

Other objects and many of the attendant advantages will be readily appreciated as the present invention becomes better understood by reference to the following detailed description when considered in conjunction with the accompanying drawings wherein:

DESCRIPTION OF THE PREFERRED EMBODIMENT

Figure 1:
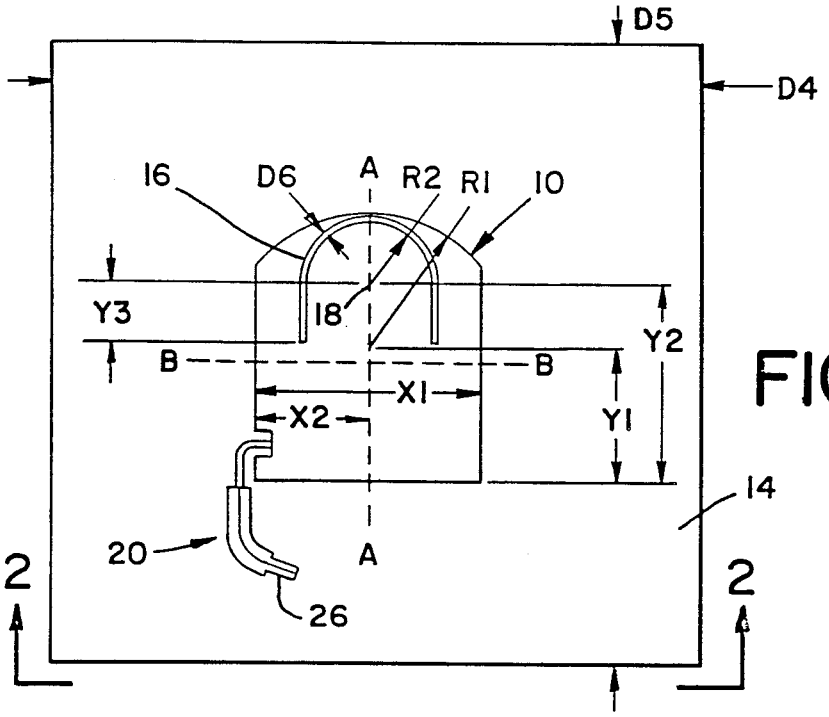
FIG. 1 is a plan view of a triple frequency microstrip antenna according to the present invention employing U-slotted radiating elements.
Figure 2:
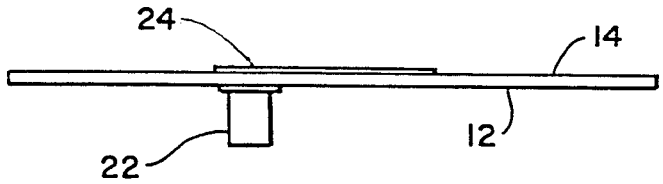
FIG. 2 is an elevation view of the antenna of FIG. 1.
Figure 3:
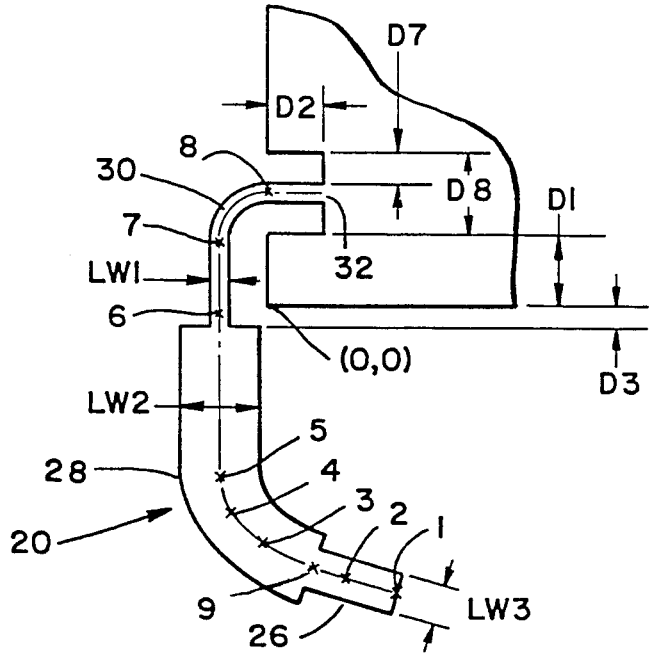
FIG. 3 is an enlarged view of the microstrip feedline to the triple-frequency radiating element of FIG. 1.

Referring now to the drawings, wherein like reference characters designate like or corresponding parts throughout the several views, FIGS. 1-3 show a preferred embodiment of a triple-frequency coplanar U-slot microstrip antenna. The antenna comprises a microstrip radiating element 10 separated from a ground plane 12 by a thin dielectric substrate 14. The microstrip radiating element 10, which is essentially rectangular in shape with a rounded front end (the top end in FIG. 1), has a width X1 and length Y1 plus R1. The radiating element 10 has a U-shaped slot 16 defined by dimensions R2, X2, Y2, and Y3. R2 is the inner radius of the curved portion of the slot 16 and has its origin at point 18 which lies on the longitudinal line at dimension X2 from the left side (as shown in FIG. 1) of the element 10 and at dimension Y2 from the rear of the element. Dimension Y3 defines the length of the straight portions of the U-shaped slot 16.

The radiating element 10 is fed from a single coplanar microstrip transmission line 20. The microstrip transmission line 20 is fed at the three frequencies from a coaxial-to-microstrip adapter (SMA connector) 22 having a center probe 24. Referring now in particular to FIG. 3, which shows the microstrip feedline 20 and its connection to the radiating element 10 in greater detail, the feedline has three sections 26, 28 and 30 of width LW3, LW2, and LW1, respectively. The coaxial-to-microstrip adapter 22 is coupled to the beginning of section 26 and section 30 is coupled to the radiating element 10 at feed point 32. The feedline widths of LW1, LW2, and LW3 provide an impedance transformation of the impedances presented by each resonance. The voltage standing wave ratio, VSWR (ref. 50 ohm), at the adapter 22 is less than 1.5:1 for each of the three resonances.

In operation, the coplanar U-slot microstrip antenna shown in FIGS. 1-3 has three resonances, designated as resonance A, resonance B and resonance C. An unslotted microstrip rectangle element has two dominant radiation modes that are polarized along line A—A and B—B, respectively. Resonances A and B correspond to the dominant microstrip radiation modes that would occur in an unslotted microstrip rectangle element having length of dimension Y1+R1 and width of dimension X1. The frequency of resonance A, the length resonance, is controlled primarily by dimensions R1 and Y1. Resonance A is polarized along line A—A. The frequency of resonance B, the width resonance, is controlled primarily by dimension X1. Resonance B is polarized along line B—B.

By introducing a slot 16 defined by dimensions R2, X2, Y2, and Y3, a third mode, resonance C, polarized along line A—A is created. Resonance C is a microstrip radiation mode charactized by an electric field distribution along the slot 16. The frequency of resonance C, the slot resonance, is primarily controlled by dimensions R2, Y3, and Y1 with the length of the slot 16 having the greater effect.

The front end of the illustrated element is rounded to shorten the effective electrical length of the radiating element (when compared to an unrounded element having a maximum length of R1+Y1). This serves to increase the frequency of length resonance A so that the frequency of the length resonance is closer to the resonance of the other two modes than would otherwise be the case (i.e., with an unrounded rectangular element).

The addition of the slot 16 affects the original two modes. With regard to the mode polarized along line A—A (length resonance A), the bandwidth and frequency of the radiation are decreased due to the inductance presented by the slot. With regard to the mode polarized along the line B—B (width resonance B), the additional inductance presented by the slot 16 decreases the frequency of the radiation without a significant reduction in bandwidth. This factor may be important in choosing whether length resonance A or slot resonance C is to be used in creating the circularly polarized signal.

Adding the slot 16 (of sufficient length to support an additional microstrip radiation mode) creates a triple frequency microstrip antenna. By proper selection of the length and location of the slot 16 (dimensions Y2, R2 and Y3), the frequency of the slot resonance C can be placed such that the 2:1 VSWR bandwidth of resonance C partially overlaps the 2:1 VSWR bandwidth of Resonance B. Since the width resonance B and slot resonance C polarizations are perpendicular to each other and the element feedpoint is located approximately at a point where resonance B and resonance C are in phase quadrature, a region of circular polarization occurs between the frequencies of width resonance B and slot resonance C. The bandwidth where circular polarization is maintained within a 3 dB axial ratio is approximately 10 percent of the 2:1 VSWR bandwidth of resonances B and C. The bandwidth where heat/polarization loss increases by 1 dB is approximately the 2:1 VSWR bandwidth of resonances B and C.

Alternatively, the length and width of the rectangular microstrip radiating element 10 can be selected to provide a region where the 2:1 VSWR bandwidth of length resonance A partially overlaps the 2:1 VSWR bandwidth of width resonance B. Since the polarizations of width resonance B and length resonance A are perpendicular to each other and the element feedpoint is located approximately at a point where resonance B and resonance A are in phase quadrature, a region of circular polarization may be created at the midpoint frequency of width resonance B and length resonance A. In this case, resonance C would have elliptical polarization. The fact that the introduction of the slot 16 reduces the bandwidth of length resonance A makes resonances B and C the preferred modes for creating the circularly polarized signal in some applications.

Thus the triple frequency U-slot microstrip antenna can be used as a dual frequency antenna—one frequency having circular polarization, composed of modes B and C, and the other frequency having elliptical polarization composed of mode A. Alternatively, the circularly polarized signal may be composed of modes A and B and the elliptically polarized signal may be composed of mode C. As a third alternative, the length and width of the radiating element and the location of the slot can be selected to provide three distinct elliptically polarized resonances.

Considering the case where modes B and C are used to provide circular polarization, the sense of circular polarization can be controlled by placing the frequency of resonance C either above or below the frequency of resonance B. The sense of circular polarization can also be controlled by placing the feedline either on the left or the right side of the element. The sense of elliptical polarization of mode A (favors either right hand circular polarization or left hand polarization) can be controlled by placing the feedline either on the left or right side of the element. These same considerations apply when controlling the sense of a circularly polarized signal created from resonance A and resonance B and an elliptically polarized resonance C.

Table 1 shows the range within which the three frequencies may lie.

TABLE 1

| |
|---|
| Resonance B Freq. ≦ Resonance C Freq. ≦ 2 · Resonance B Freq. Resonance A Freq. ≦ 0.9 · Resonance C Freq. 0.7 · Resonance B Freq. ≦ Resonance A Freq. ≦ 1.5 · Resonance B Freq. |

The feedline widths of LW1, LW2, and LW3 achieve an impedance transformation of the three impedances presented by resonances A, B, and C.

A triple frequency U-slot antenna as illustrated in FIGS. 1–3 has been constructed to achieve circular polarization at 1575 MHz and elliptical polarization favoring right hand circular polarization at 1381 MHz. The dimensions of this embodiment are given in Table 2. These dimensions are based on a 0.125 inch thich teflon/fiberglass substrate having a dielectric constant of 2.55 and a dissipation factor less than 0.002. Feedline centerline coordinates 1–8, and dimensions D1–D8 associated with the feedline input point are defined in FIG. 3. The feedline coordinates (X,Y) are in inches from an origin (0,0) located at the lower left corner of the radiating element 10 with the positive X direction being to the right in the figure and the positive Y direction being upward.

TABLE 2

| Dimensions in Inches | |
|---|---|
| X1 = 1.949 | D1 = 0.227 |
| X2 = 1.949 | D2 = 0.168 |
| Y1 = 1.265 | D3 = 0.060 |
| Y2 = 1.908 | D4 = 6.000 |
| Y3 = 0.593 | D5 = 6.000 |
| R1 = 1.304 | D6 = 0.063 |
| R2 = 0.565 | D7 = 0.100 |
| LW1 = 0.051 | D8 = 0.251 |
| LW2 = 0.230 | |
| LW3 = 0.125 | |
| **Feedline Centerline Coordinates X, Y in Inches** | |
| (1) = (0.371, −0.876) | |
| (2) = (0.227, −0.839) | |
| (3) = (−0.014, −0.739) | |
| (4) = (−0.110, −0.639) | |
| (5) = (−0.1465, −0.539) | |
| (6) = (−0.1465, 0.000) | |
| (7) = (−0.1465, 0.2055) | |
| (8) = (0.000, 0.352) | |
| (9) = (0.134, −0.880) | |

Points (7) and (8) are end points of an arc defined by a radius of 0.1465 and a center of rotation (0.0, 0.2055).

Figure 4:
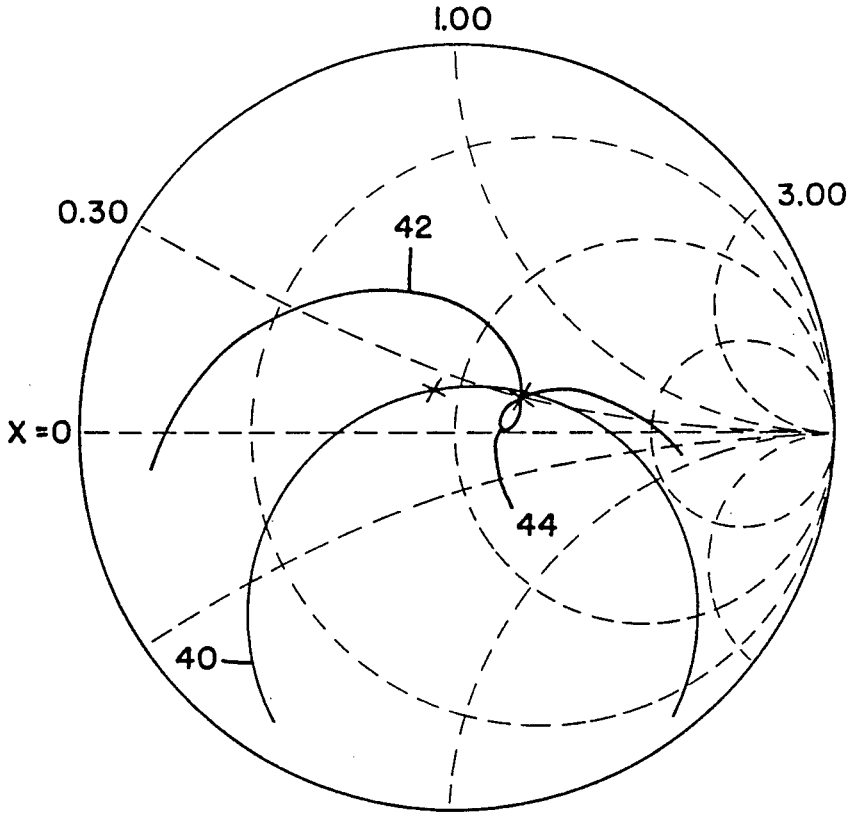
FIG. 4 shows a representative impedance plot for a U-slotted radiating element designed to have an elliptically polarized lower frequency and a circularly polarized upper frequency.
Figure 5A:
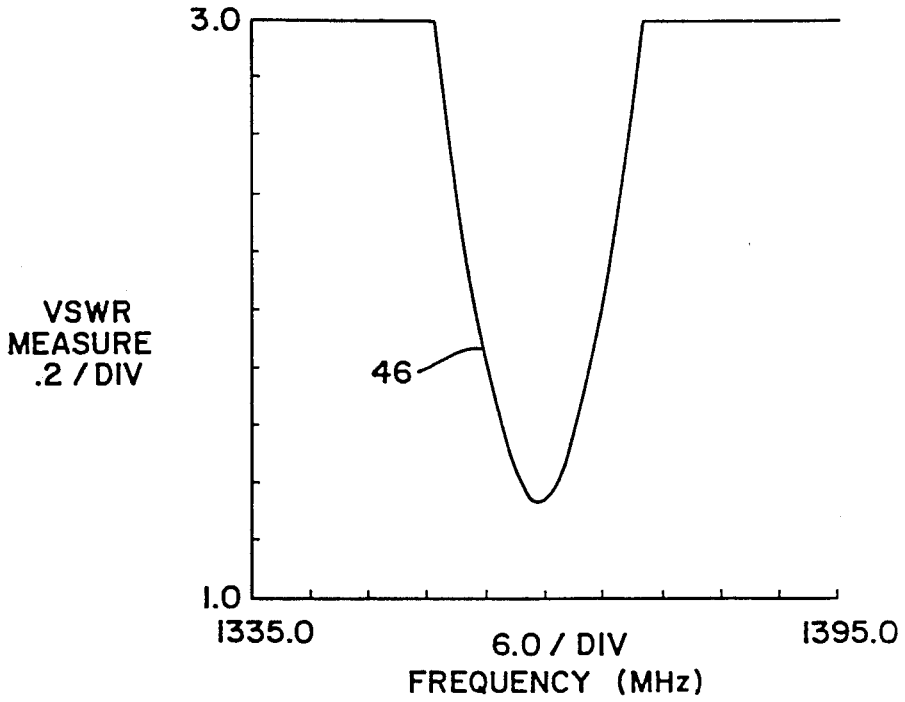
FIGS. 5A and 5B are plots of VSWR versus frequency for a representative U-slotted radiating element having an elliptically polarized lower frequency and a circularly polarized upper frequency.
Figure 5B:
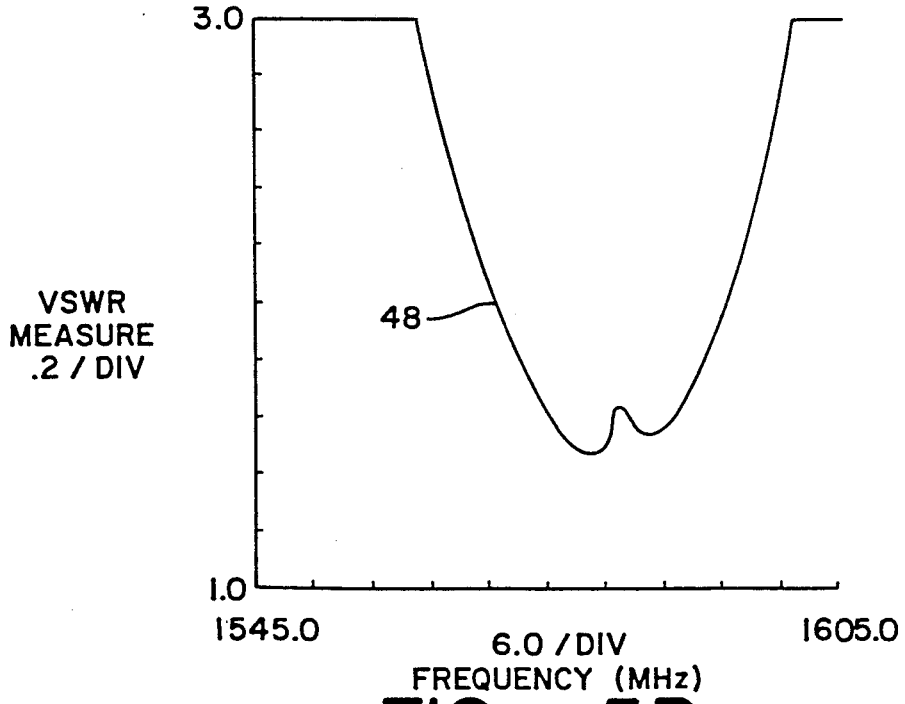
Figure 6:
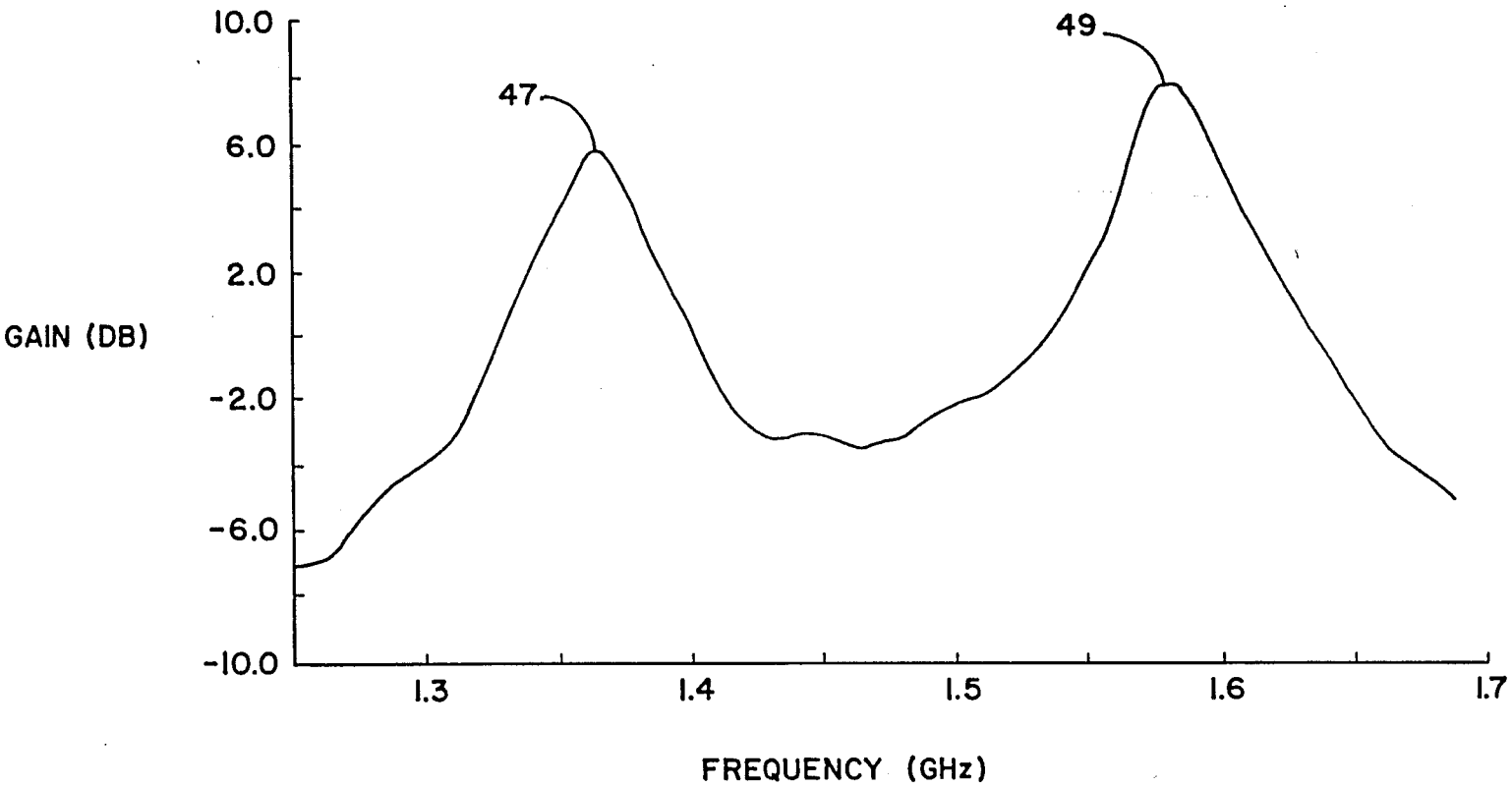
FIG. 6 is a plot of gain versus frequency for a representative U-slotted radiating element designed to have an elliptically polarized lower frequency and a circularly polarized upper frequency.

FIGS. 4, 5, and 6 illustrate the operation of an embodiment of the antenna of FIG. 1 having the dimensions given in Table 2. Referring to the impedance plot (Smith Chart) of FIG. 4, curve 40 was obtained at 1364 MHz and represents the length resonance A. Curve 42 was obtained at 1583 MHz and represents the combination of the width resonance B and the slot resonance C. The cusp 44 indicates that two distinct resonances are present.

FIG. 5 is a plot of VSWR versus frequency at these same frequencies. Curve 46 and curve 48 were obtained at 1364 MHz and 1583 MHz, respectively. FIG. 6 is a plot of gain (with respect to a linearly polarized isotropic antenna) versus frequency and shows the length resonance 47 at 1364 MHz and a second resonance 49 at 1583 MHz where the slot resonance and the width resonance combine to provide a circularly polarized signal.

Figure 7:
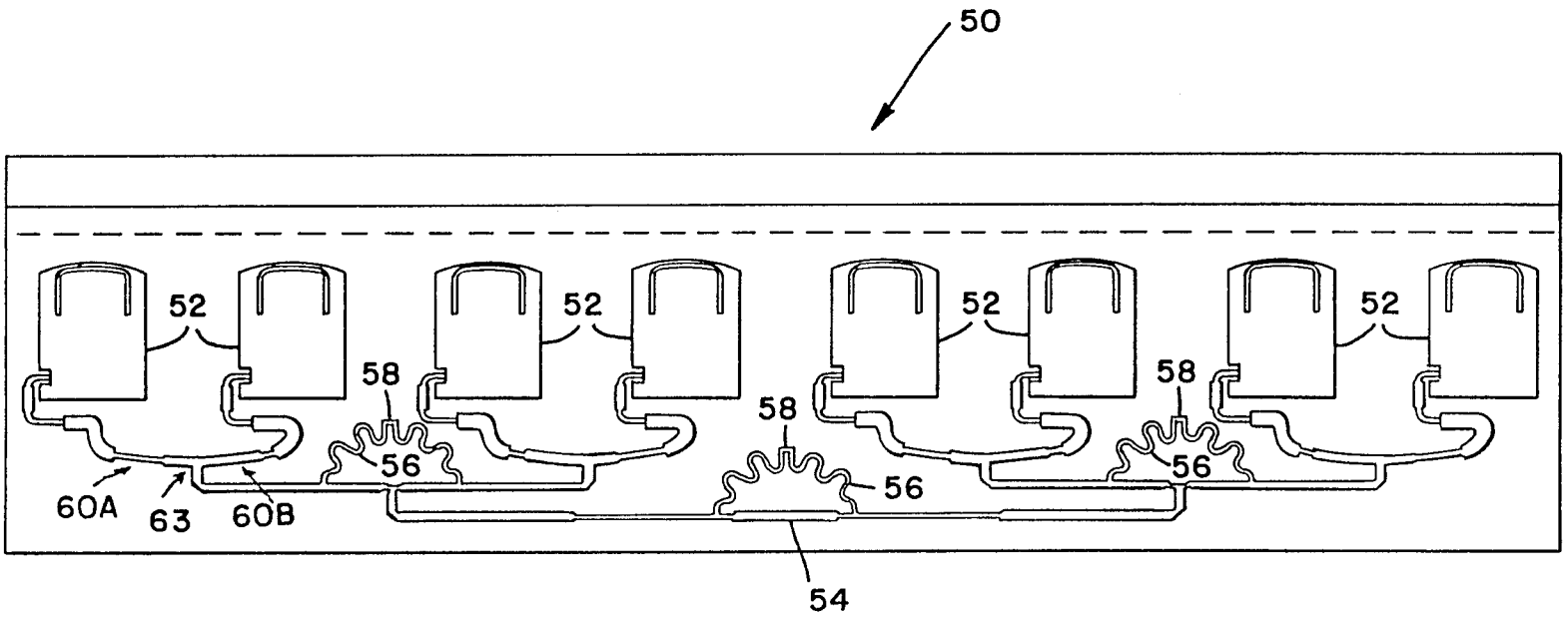
FIG. 7 is a plan view of an array antenna incorporating U-slot elements.

Referring now to FIG. 7, there is shown an antenna array 50 incorporating U-slotted radiating elements 52 in which the microstrip feednetwork and the elements are etched on the same copper surface concurrently. The array 50 is used as an one-eighth section of a circular array. The design consists of an array of eight U-slot radiating elements 52 operating at 1386 MHz and 1580 MHz that is fed by a single microstrip feed network coupled to a coaxial-to-microstrip adapter (not shown) at feed point 54. The microstrip feed network has isolators at the four-way and eight-way junctions that reduce the extent to which the feed network is unbalanced by random variations in element dimensions and substrate dielectric. Meander lines 56 which terminate in a thin film resistor 58 are provided to prevent reflected energy from the antenna element from coupling to the feedlines.

The line width transitions at the interconnection points between the feed network and the element feedlines 60*a* and 60*b* are used to provide compensation for imbalances that would normally occur due to coupling between the parallel lines of the feed network. The compensation is achieved through impedance changes at the line width transitions which alter the power distribution through the two-way junction output ports 60.

Figure 8:
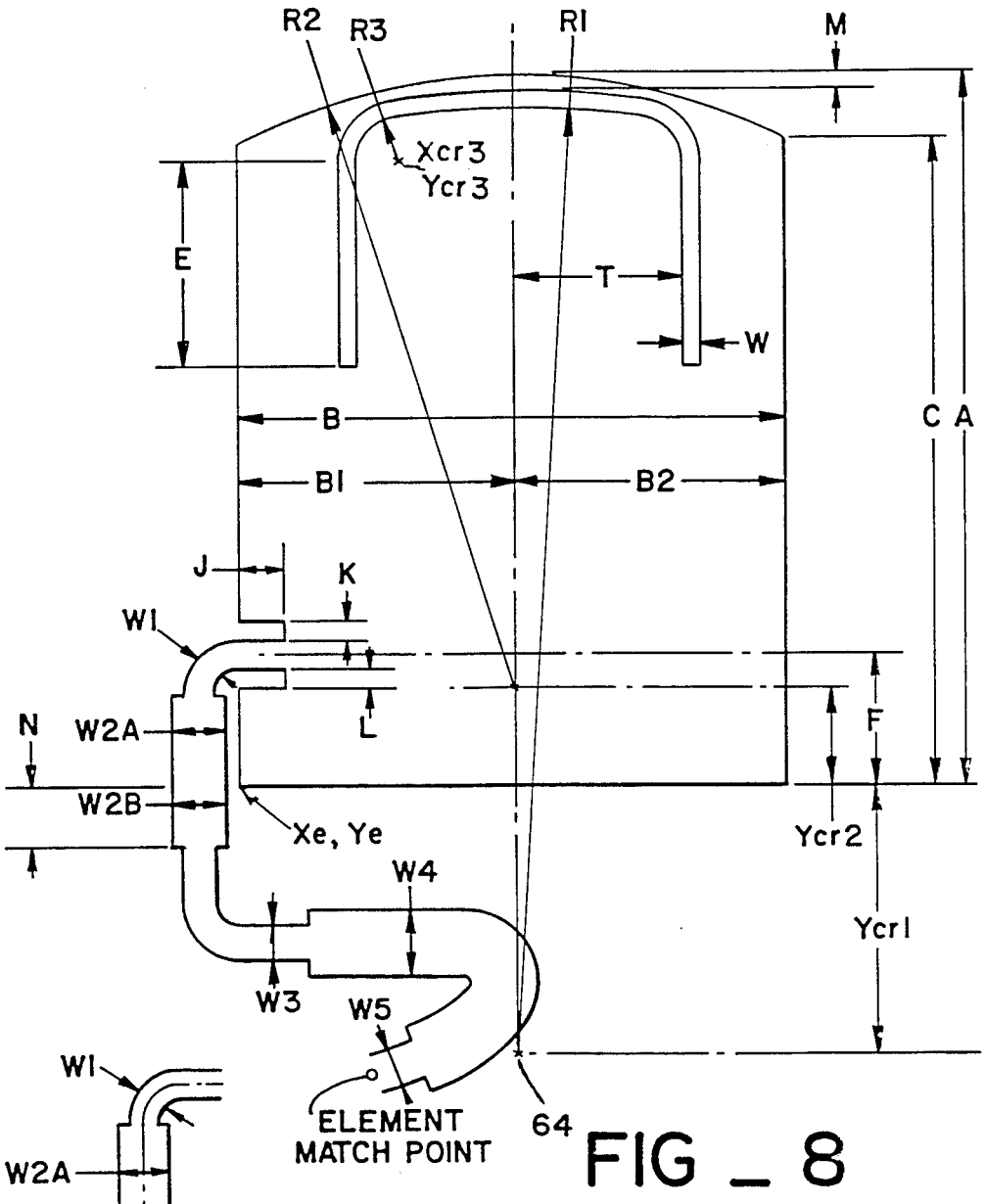
FIG. 8 is a plan view of a right-hand U-slotted radiating element and associated element feedline of the antenna of FIG. 7.
Figure 9:
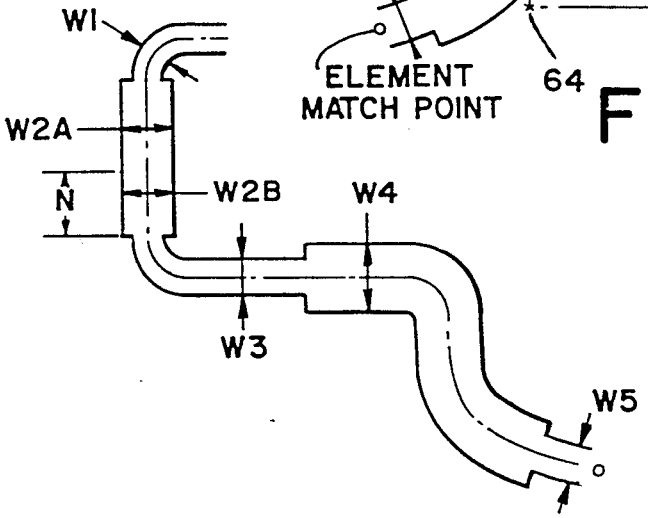
FIG. 9 is a plan view illustrating the element feedline of a left hand element of the antenna of FIG. 7.

FIGS. 8 and 9 illustrate the U-slotted radiating element 52 and the element feedlines 60*a* and 60*b* in more detail. Table 3 gives the dimensions of the U-slotted radiating element 52 and the element feedlines.

TABLE 3

| Dimensions in Inches | |
|---|---|
| A = 2.621 | W = 0.063 |
| B = 2.004 | W1 = 0.105 |
| B1 = 1.035 | W2A = 0.168 |
| B2 = 0.969 | W2B = 0.205 |
| C = 2.403 | W3 = 0.125 |
| E = 0.777 | W4 = 0.245 |
| F = 0.494 | W5 = 0.125 |
| J = 0.175 | T = 0.600 |
| K = 0.073 | Ycr1 = 1.004 |
| L = 0.073 | Ycr2 = 0.361 |
| M = 0.062 | Xcr3 = 0.428 |
| N = 0.230 | Ycr3 = 3.300 |
| R1 = 3.500 | Xe = 0.8835 |
| R2 = 2.260 | Ye = 1.215 |
| R3 = 0.172 | |

The dimensions Xe and Ye are with respect to the feed netowrk 2-way junction center-point 63. The dimensions Xcr3 and Ycr3, the location of the center of rotation of R3, are with respect to the center of rotation of R1 at point 64.

From the foreging description of the preferred embodiment, it is apparent that the present invention provides a low profile, microstrip antenna or microstrip antenna array capable of supporting instantaneous three- frequency operation with a single coplanar feed network. The described antenna provides either triple-frequency operation or dual frequency operation in which one frequency is circularly polarized and the other frequency is elliptically polarized in a smaller, more efficient and less complex antenna.

Obviously, many modifications and variations of the present invention are possible in light of the above teachings. It is therefore to be understood that within the scope of the appended claims, the invention may be practiced otherwise than as described.

What is claimed and desired to be secured by Letters Patent of the United States is:

1. A triple frequency microstrip antenna comprising:
(a) a thin dielectric substrate;
(b) a thin conductive layer disposed on one surface of said substrate, said conductive layer forming a ground plane;
(c) a thin conductive rectangular radiating element disposed on the other surface of said substrate, said rectangular radiating element having a length, a width, and a front end, said rectangular radiating element having a first resonance polarized in a direction parallel to the length of said radiating element, and a second resonance polarized in a direction parallel to the width of said radiating element;
(d) said radiating element having a U-shaped slot oriented parallel to the length to create a third resonance in the direction parallel to the length of said radiating element; and
(e) a single microstrip feedline for coupling radio frequency signals to said radiating element, said single feedline being coplanar with said radiating element.

2. A triple frequency microstrip antenna as recited in claim 1 wherein said single microstrip feedline is coupled to a feedpoint near a corner of said rectangular radiating element.

3. A triple frequency microstrip antenna as recited in claim 2 wherein said feedpoint is located approximately where the first resonance and the second resonance are in phase quadrature.

4. A triple frequency microstrip antenna as recited in claim 3 wherein the dimensions of said feedline are adapted to match the impedance of the feedline to the impedance of the rectangular radiating element at said first, second and third resonances.

5. A triple frequency microstrip antenna as recited in claim 2 wherein said single microstrip feedline is coupled to said feedpoint from the side of said rectangular radiating element near a rear corner of said rectangular radiating element.

6. A triple frequency microstrip antenna as recited in claim 5 wherein the front end of said rectangular radiating element is rounded to shorten the effective electrical length of said radiating rectangular element.

7. A triple frequency microstrip antenna as recited in claim 6 wherein said slot is disposed near the front end of said rectangular radiating element.

8. A triple frequency microstrip antenna as recited in claim 7 wherein the dimensions and location of said slot are chosen so the bandwidth of the third resonance partially overlaps the bandwidth of the second resonance.

9. A triple frequency microstrip antenna as recited in claim 8 wherein the dimensions and location of said slot are chosen so the bandwidth of the third resonance partially overlaps the bandwidth of the second resonance to provide a region of circular polarization between said second resonance and said third resonance.

10. A triple frequency microstrip antenna as recited in claim 7 wherein the dimensions of said rectangular radiating element are chosen so that the bandwidth of said first resonance partially overlaps the bandwidth of said second resonance.

11. A triple frequency microstrip antenna as recited in claim 10 wherein the dimensions of said rectangular radiating element are chosen so the bandwidth of the first resonance partially overlaps the bandwidth of the second resonance to provide a region of circular polarization between said first resonance and said second resonance.

12. A triple frequency microstrip antenna array comprising:
(a) a thin dielectric substrate;
(b) a thin conductive layer disposed on one surface of said substrate, said conductive layer forming a ground plane;
(c) a plurality of thin conductive rectangular radiating elements disposed on the other surface of said substrate, said rectangular radiating elements having a length and a width, each of said rectangular radiating elements having a first resonance polarized in a direction parallel to the length of said radiating element, and a second resonance polarized in a direction parallel to the width of said radiating element;
(d) each of said radiating elements having a U-shaped slot disposed to create a third resonance in the direction parallel to the length of said radiating element; and
(e) a microstrip feed network for coupling radio frequency signals to said radiating elements, said microstrip feed network being coplanar with said radiating elements and having a single feedpoint.

* * * * *